US011724493B2

(12) United States Patent
Akiyama

(10) Patent No.: US 11,724,493 B2
(45) Date of Patent: Aug. 15, 2023

(54) LIQUID DISCHARGE DEVICE AND LIQUID DISCHARGING METHOD

(71) Applicant: Kohta Akiyama, Kanagawa (JP)

(72) Inventor: Kohta Akiyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 117 days.

(21) Appl. No.: 17/377,866

(22) Filed: Jul. 16, 2021

(65) Prior Publication Data

US 2022/0032614 A1 Feb. 3, 2022

(30) Foreign Application Priority Data

Jul. 30, 2020 (JP) ..... 2020-129367

(51) Int. Cl.
*B41J 29/38* (2006.01)
*B41J 2/045* (2006.01)

(52) U.S. Cl.
CPC ..... *B41J 2/04588* (2013.01); *B41J 2/04541* (2013.01); *B41J 2/04581* (2013.01); *B41J 2/04593* (2013.01)

(58) Field of Classification Search
CPC .. B41J 2/04541; B41J 2/0451; B41J 2/04525; B41J 2/04588
See application file for complete search history.

(56) References Cited

U.S. PATENT DOCUMENTS

| | | | | |
|---|---|---|---|---|
| 9,944,070 | B1 * | 4/2018 | Howkins | B41J 2/0451 |
| 2017/0326874 | A1 | 11/2017 | Akiyama | |
| 2019/0217607 | A1 | 7/2019 | Akiyama et al. | |
| 2020/0171828 | A1 | 6/2020 | Matsufuji et al. | |
| 2020/0290352 | A1 | 9/2020 | Akiyama et al. | |

FOREIGN PATENT DOCUMENTS

| | | |
|---|---|---|
| JP | 2015-231700 | 12/2015 |
| JP | 2016-078361 | 5/2016 |
| JP | 2017-087507 | 5/2017 |

* cited by examiner

*Primary Examiner* — Lam S Nguyen
(74) *Attorney, Agent, or Firm* — Harness, Dickey & Pierce, P.L.C.

(57) ABSTRACT

A liquid discharge device and a method of discharging liquid. The liquid discharge device includes a head driver to drive an actuator element to generate force to discharge an ink droplet from a head onto an object to be conveyed, the object to be conveyed moving relative to the head, and a discharge controller. The discharge controller and the method includes computing a first drive cycle according to an amount of relative movement of the object moving relative to a head, adjusting the first drive cycle to a value within a second cycle range different from a first cycle range in which an ink droplet is abnormally discharged from the head, obtaining a second drive cycle as a result of adjustment performed on the first drive cycle, every time the second drive cycle passes one or more times, and adjusting the first drive cycle.

7 Claims, 11 Drawing Sheets

| MN SIGNAL (SELECTIVE DRIVING SIGNAL) | AMOUNT OF DROP TO BE DISCHARGED |
|---|---|
| MN0 | 0pl |
| MN1 | 3pl |
| MN2 | 9pl |
| MN3 | 18pl |

LIQUID DISCHARGE DEVICE AND LIQUID DISCHARGING METHOD

CROSS-REFERENCE TO RELATED APPLICATION

This patent application is based on and claims priority pursuant to 35 U.S.C. § 119(a) to Japanese Patent Application No. 2020-129367, filed on Jul. 30, 2020, in the Japan Patent Office, the entire disclosure of which is hereby incorporated by reference herein.

BACKGROUND

Technical Field

Embodiments of the present disclosure relates to a liquid discharge device and a liquid discharging method.

Background Art

Conventionally, liquid discharge devices such as image forming apparatuses using a head such as an inkjet head are known in the art. In the liquid discharge device as described above, when an actuator element such as a piezoelectric element is driven to eject an ink droplet such as ink, the entire inkjet head or a part of the structure may resonate to cause an unstable ejection state, or the ejection speed of the ink droplet may change to deteriorate image quality. This may be due to the fact that the structural resonance frequency of the inkjet head matches or is close to the drive frequency of the inkjet head, i.e., the frequency at which ink is discharged from the nozzles.

In order to handle such a situation, technologies are known in the art in which a frequency specifying unit that specifies a frequency that affects the resonance of the nozzle based on the vibration waveform detected by a vibration detecting unit that detects the vibration of the actuator element and a shape of the generated driving signal is changed based on the specified frequency to correct frequency characteristics, in order to prevent the occurrence of crosstalk due to the resonance of the nozzle in consideration of changes over time and individual differences of the ink droplet ejection apparatus that ejects ink droplets from the nozzle by a drive waveform composed of a plurality of driving pulses within one print cycle.

SUMMARY

Embodiments of the present disclosure described herein provide a liquid discharge device and a method of discharging liquid. The liquid discharge device includes a head driver configured to drive an actuator element to generate force to discharge an ink droplet from a head onto an object to be conveyed, the object to be conveyed moving relative to the head, and a discharge controller. The discharge controller and the method includes computing a first drive cycle according to an amount of relative movement of an object to be conveyed moving relative to a head, adjusting the first drive cycle to a value within a second cycle range different from a first cycle range in which an ink droplet is abnormally discharged from the head, obtaining a second drive cycle as a result of adjustment performed on the first drive cycle, every time the second drive cycle passes one or more times, adjusting the first drive cycle such that a difference between an accumulated value of the first drive cycle of a prescribed number of consecutive times and an accumulated value of the second drive cycle of a prescribed number of consecutive times does not exceed a permissible value, and driving an actuator element that generates force to discharge an ink droplet from the head onto the object to be conveyed in the second driving cycle.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

Figure 1:
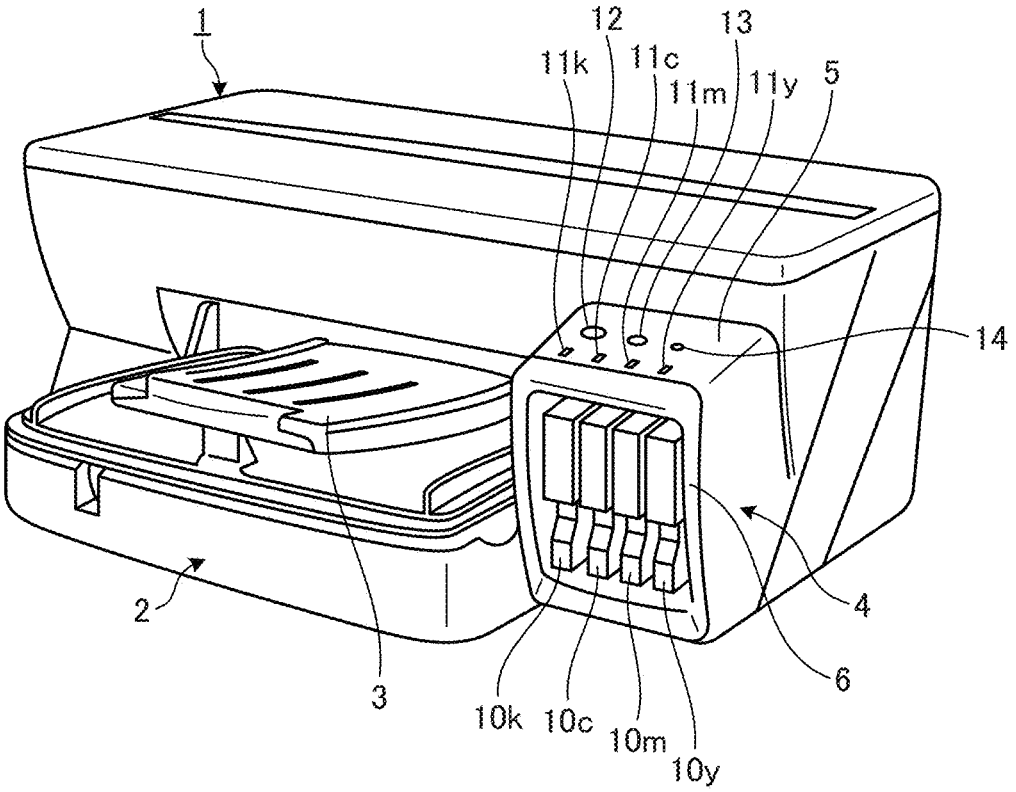
FIG. 1 is a diagram illustrating a configuration or structure of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

An image forming apparatus provided with a liquid discharge device and a liquid discharging method according to an embodiment of the present disclosure is described below with reference to the accompanying drawings. However, no limitation is indicated thereby, and various applications and modifications may be made without departing from the scope of the invention. In the drawings, like reference signs denote like elements, and overlapping description may be simplified or omitted as appropriate.

FIG. 1 is a diagram illustrating an image forming apparatus that serves as a liquid discharge device, according to the present embodiment.

The image forming apparatus according to the present embodiment includes a main structural frame 1, a feed tray 2 attached to the main structural frame 1 to store sheets of paper, and an output tray 3 that is provided for the main structural frame 1 in a detachable manner stores a sheet of paper on which an image has been formed. The sheet of paper is an example of an object to be conveyed. An ink is an example of liquid, and the drop of ink that is discharged onto the sheet of paper is an example of an ink droplet discharged onto the sheet of paper that serves as an object to be conveyed. Further, the image forming apparatus according to the present embodiment is provided with a cartridge case 4 that accommodates ink cartridges 10*k*, 10*c*, 10*m*, and 10*y*. The cartridge case 4 is located on one end side of the front of the main structural frame 1. In other words, the cartridge case 4 is adjacent to the feed tray and the output tray. The cartridge case 4 protrudes from the front of the main structural frame 1 and its top face is lower than the top face of the main structural frame 1. The cartridge case 4 is provided with an operation and display unit 5 on the top face, and the operation and display unit 5 has, for example, operation keys and indicators.

For example, the ink cartridges 10*k*, 10*c*, 10*m*, and 10*y* that contain black (K) ink, cyan (C) ink, magenta (M) ink, and yellow (Y) ink, respectively, can be inserted into the cartridge case 4 from the front side of the main structural frame 1 toward the rear side. Moreover, the cartridge case 4 is provided with an openable and closable cartridge cover 6 on the front side. The cartridge cover 6 is a front cover that is opened when some of the ink cartridges 10*k*, 10*c*, 10*m*, and 10*y* is attached or detached.

On the operation and display unit 5, remaining-amount indicators 11*k*, 11*c*, 11*m*, and 11*y* of the respective colors are arranged. The positions of the remaining amount indicators 11*k*, 11*c*, 11*m*, and 11*y* correspond to the positions of the ink cartridges 10*k*, 10*c*, 10*m*, and 10*y* of the respective colors to indicate that the remaining amount of at least one of the ink cartridges is zero or almost zero. Further, the operation and display unit 5 includes a power switch 12, a feed resume or print resume key 13, and a cancellation key 14 that are arranged on the top face of the operation and display unit 5.

Figure 2:
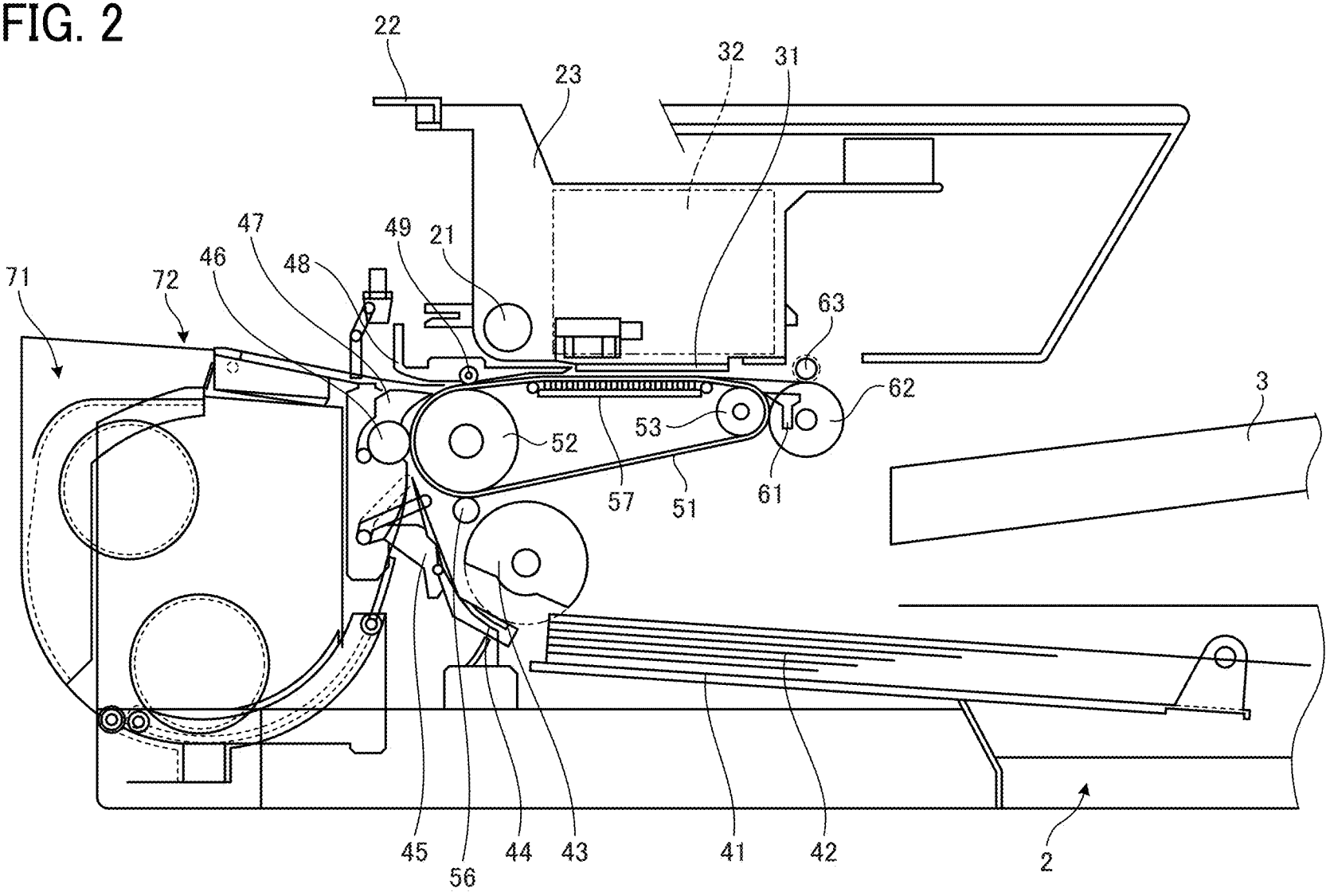
FIG. 2 is a schematic diagram illustrating a mechanical section of an image forming apparatus according to an embodiment of the present disclosure.

FIG. 2 is a schematic diagram illustrating a mechanical section of the image forming apparatus according to the present embodiment.

Figure 3:
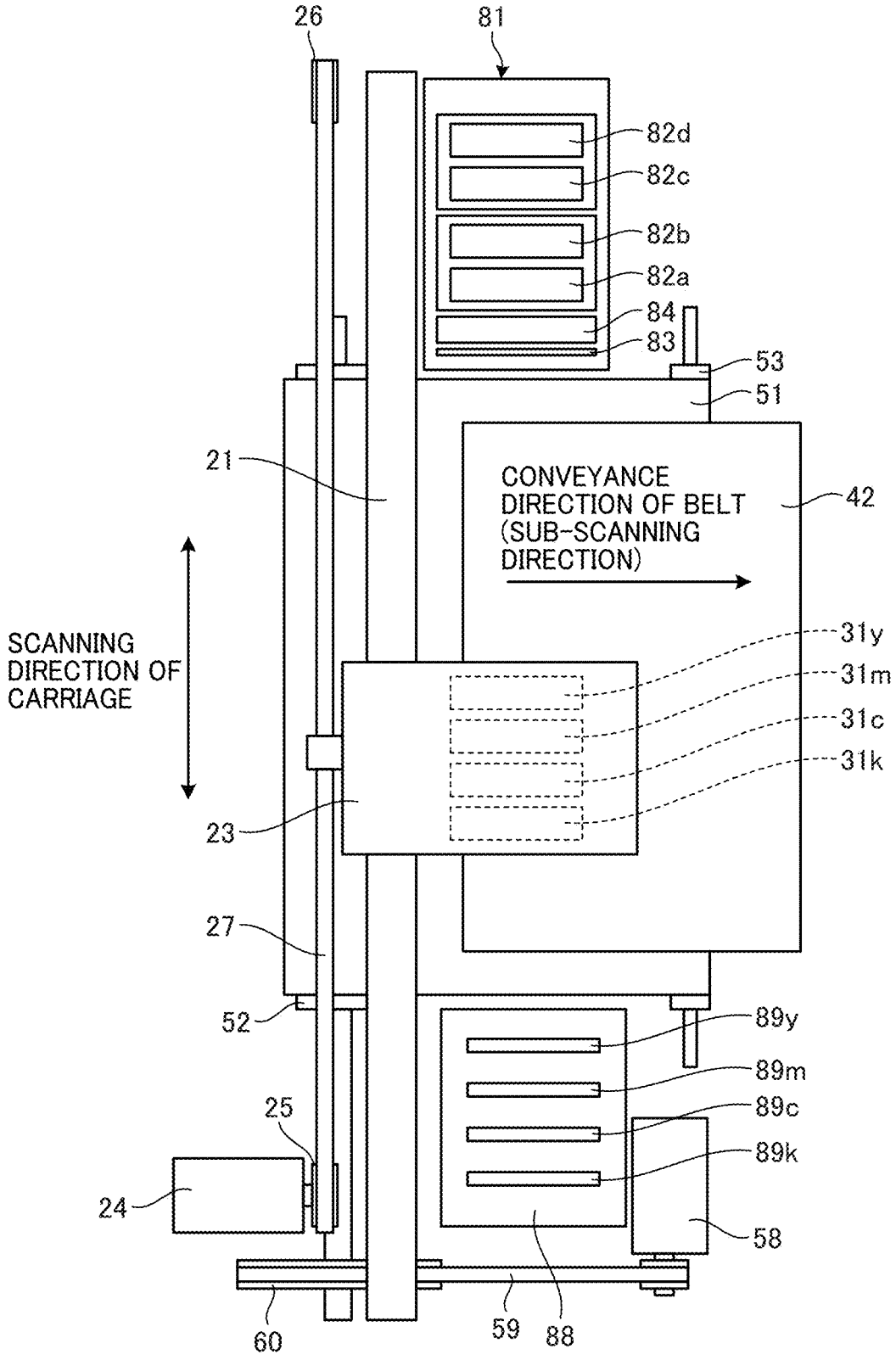
FIG. 3 is a schematic plan view of a mechanical section of an image forming apparatus according to an embodiment of the present disclosure.

FIG. 3 is a schematic plan view of a mechanical section of the image forming apparatus according to the present embodiment.

In the present embodiment, a carriage 23 is slidably held in the main scanning direction by a guide rod 21 and a stay 22 that are guide units laterally bridged between right and left side plates. The carriage 23 performs scanning while being moved by a main-scanning motor 24 in the directions indicated by an arrow, through a timing belt 27 laid across and stretched between a drive pulley 25 and a driven pulley 26.

On the carriage 23, recording heads 31*k*, 31*c*, 31*m*, and 31*y* as heads (inkjet heads) for ejecting ink droplets of the respective colors described above are mounted such that a plurality of ink ejection ports are arranged in a direction intersecting the main scanning direction and the ink droplet ejection direction is directed downward.

As the inkjet head, for example, a head including a piezoelectric actuator such as a piezoelectric element, a thermal actuator using a phase change due to film boiling of liquid using an electrothermal conversion element such as a heating resistor, as an actuator element that generates force to discharge ejecting ink droplets, can be used. In addition to the above, for example, a shape-memory alloy actuator using metal phase change due to temperature change, an electrostatic actuator using electrostatic force, can be used as an actuator element.

The inkjet head may have a configuration in which a plurality of nozzle rows are provided by arranging a plurality of nozzles, and droplets of the same color are discharged from each nozzle row, or may have a configuration in which droplets of different colors are discharged. Moreover, a plurality of head tanks 32 of the respective colors that supply the inks of the respective colors to the recording heads 31*k*, 31*c*, 31*m*, and 31*y* are mounted on the carriage 23.

The head tank 32 is supplied with ink of each color from the ink cartridges 10*k*, 10*c*, 10*m*, and 10*y* of each color mounted on the cartridge case 4 through the ink supply tube of each color. On the other hand, the feed roller 43 and a separation pad 44 are provided as a sheet feeder that feeds the sheet of paper 42 stacked on the sheet stacking portion 41 of the feed tray 2. The feed roller 43 separates and feeds the sheet of papers 42 on a one-piece-by-one-piece basis from the sheet stacking portion 41. The separation pad 44 is made of a material having a large friction coefficient, faces the feed roller 43, and is biased toward the feed roller 43.

The image forming apparatus according to the present embodiment includes a guide unit 45 that guides the sheet of paper 42, a counter roller 46, a conveyance guide unit 47, and a pressing member 48 provided with a leading-end pressure roller 49. With this configuration, the sheet of paper 42 that is fed from the sheet feeder is fed to the lower side of the recording heads 31*k*, 31*c*, 31*m*, and 31*y*. The image forming apparatus according to the present embodiment further includes a conveyance belt 51 that electrostatically attracts the fed sheet of paper 42 and conveys it at a position facing the recording heads 31*k*, 31*c*, 31*m*, and 31*y*.

The conveyance belt 51 is an endless belt stretched between the conveyance roller 52 and the tension roller 53 and goes around in the conveyance direction of the belt. In other words, the conveyance belt 51 goes around in the sub-scanning direction. The conveyance belt 51 has a surface layer serving as a paper attracting surface and a back layer made of the same material as the surface layer and having resistance controlled by carbon. The surface layer is formed of, for example, a pure resin material having a thickness of about 40 micrometers (μm) without resistance control, for example, an ethylene tetrafluoroethylene (ETFE) pure material, and the back layer is formed of, for example, a medium-resistance layer or a ground layer.

The image forming apparatus according to the present embodiment includes a charging roller 56 that serves as a charger to charge a surface of the conveyance belt 51. The charging roller 56 is arranged so as to contact the surface layer of the conveyance belt 51 and to rotate a driven by the rotation of the conveyance belt 51 and applies prescribed pressing force through both ends of the axis.

The conveyance roller 52 also serves as a ground roller, and is disposed in contact with the medium-resistance layer of the conveyance belt 51 and grounded. A guide unit 57 is disposed on the rear side of the conveyance belt 51 so as to correspond to the printing areas of the recording heads 31*k*, 31*c*, 31*m*, and 31*y*.

The guide unit 57 is projected to the recording head 35 side from a tangent line of two rollers including a conveyance roller 52 and a tension roller 53 whose top faces support the conveyance belt 51. Due to such a configuration, the highly accurate flatness or smoothness of the conveyance belt 51 is maintained. The conveyance roller 52 is rotationally driven by the sub-scanning motor 58 via the drive belt 59 and the pulley 60, so that the conveyance belt 51 moves in the belt conveyance direction in FIG. 3, that is, in the sub-scanning direction.

Further, as a sheet ejection unit for discharging the paper 42 recorded by the recording heads 31*k*, 31*c*, 31*m*, and 31*y*, a separation claw 61 for separating the paper 42 from the conveyance belt 51, a output roller pair 62, and a output roller pair 63 are provided, and the output tray 3 is provided below the output roller pair 62.

A double-sided unit 71 is attached to the rear side of the main structural frame 1 in a detachable manner. The double-sided unit 71 takes in the sheet of paper 42 returned by the reverse rotation of the conveyance belt 51, and reverses it to feeds the sheet of paper 42 again to the nip between the counter roller 46 and the conveyance belt 51. Moreover, the upper side of the double-sided unit 71 serves as a manual sheet feeding tray 72.

Further, as illustrated in FIG. 3, a maintenance-and-recovery unit 81 that maintains and recovers the state of the nozzles of the recording heads 31*k*, 31*c*, 31*m*, and 31*y* is disposed in a non-print area on one side of the pair of scanning directions of the carriage 23. The maintenance-and-recovery unit 81 includes, for example, a plurality of caps 82*a* to 82*d*, a wiper blade 83, and a dummy discharge receptacle 84.

The caps 82*a* to 82*d* cap the faces of the multiple nozzle plates of the recording heads 31*k*, 31*c*, 31*m*, and 31*y*. The wiper blade 83 is a blade used to wipe the face of a nozzle plate. The dummy discharge receptacle 84 receives droplets when dummy discharge is performed to discharge droplets that have no influence on recording in order to discharge the thickened recording liquid. In the present embodiment, the cap 82*a* is a suction and moisture-retentive cap, and the other caps 82*b* to 82*d* are moisture-retentive caps. The cap 82*a* may be referred to as a suction cap in the following description.

In a non-print area on the other side in the scanning direction of the carriage 23, a dummy discharge receptacle 88 is arranged for receiving ink droplets when dummy discharge is performed for ejecting ink droplets not contributing to recording in order to discharge the recording liquid that is thickened during, for example, the recording operation. The dummy discharge receptacle 88 is provided with openings 89*a* to 89*d* in the column direction of the nozzles of the recording heads 31*k*, 31*c*, 31*m*, and 31*y*.

In the ink jet recording apparatus configured as described above, the sheet of paper 42 is separately fed from the feed tray 2 on a one-piece-by-one-piece basis, and the sheet of paper 42 that is fed substantially vertically upward is guided by a guide unit 45. Then, the sheet of paper 42 is nipped between the conveyance belt 51 and the counter roller 46 and is conveyed. Further, the leading end of the sheet of paper 42 is guided by a conveyance guide, and the sheet of paper 42 is pressed against the conveyance belt 51 by the leading-end pressure roller 49 to change the conveyance direction by approximately 90 degrees.

In so doing, positive power and negative power, i.e., alternating voltage, are alternately and repeatedly output and applied from an alternating-current (AC) bias supply unit to the charging roller 56 by a control circuit, and the conveyance belt 51 attains an alternating charged-voltage pattern. In other words, the conveyance belt 51 is alternately charged with the positive and negative in a belt-like manner with a prescribed width in a sub-scanning direction, i.e., the rotating direction.

Once the sheet of paper 42 is fed onto the conveyance belt 51 that is alternately charged with positive and negative voltages, the sheet of paper 42 adheres to the conveyance belt 51, and the sheets of paper 42 conveyed in the sub-scanning direction as the conveyance belt 51 moves and goes around. Then, the recording heads 31*k*, 31*c*, 31*m*, and 31*y* are driven according to the image signals while the carriage 23 is being moved. In so doing, ink droplets are discharged to the sheet of paper 42 at a standstill to record a single line of the image. Then, the sheet of paper 42 is conveyed in a prescribed amount, and the next line of the image is recorded.

Once a recording end signal or a signal indicating that a trailing end of the sheet of paper 42 has reached a recording area is received, the recording operation is terminated, and the sheet of paper 42 is ejected to the output tray 3. While the system is on standby waiting for next printing operation, the carriage 23 is moved to the maintenance-and-recovery unit 81 side, and the recording heads 31*k*, 31*c*, 31*m*, and 31*y* are capped by the caps 82*a*, 82*b*, 82*c*, and 82*d*. Accordingly, the nozzles can be kept moist or wet, and the failure of discharge due to dried ink can be prevented.

Moreover, in a state where the recording heads 31*k*, 31*c*, 31*m*, and 31*y* are capped by the caps 82*a*, 82*b*, 82*c*, and 82*d*, respectively, a recovery operation is performed in which the recording liquid is sucked from the nozzles by a suction pump and the thickened recording liquid or air bubbles are discharged. For example, before the start of recording or during the recording, a dummy discharge operation is performed to discharge ink unrelated to recording toward the dummy discharge receptacles 84 and 88. In other words, ink droplets that do not contribute to image formation are discharged. By so doing, stable discharging performance of the recording heads 31*k*, 31*c*, 31*m*, and 31*y* can be maintained or recovered.

Figure 4:
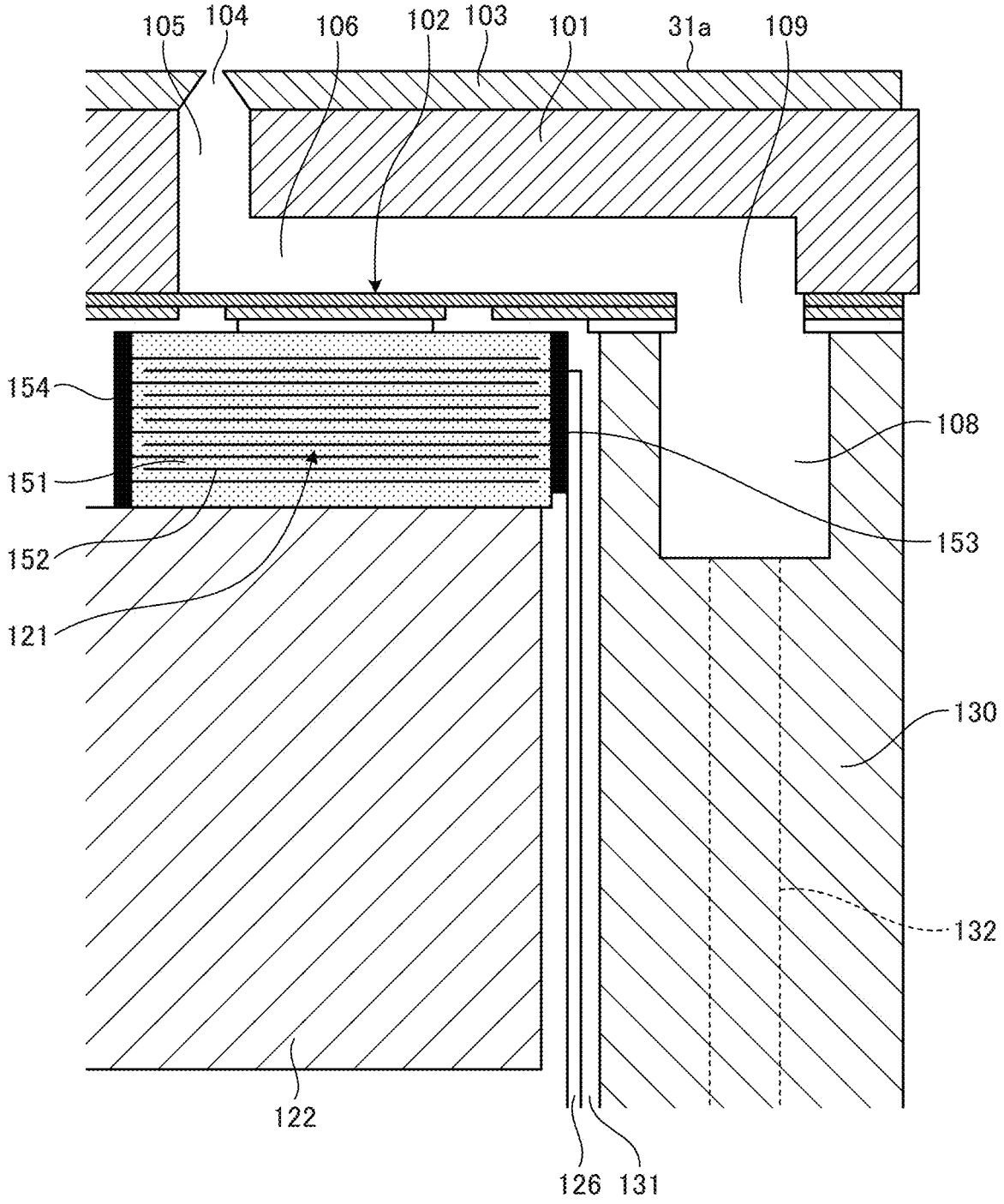
FIG. 4 is a sectional view of a liquid discharge head that serves as a recording head of an image forming apparatus, parallel to the longer-side direction of a liquid chamber, according to an embodiment of the present disclosure.

FIG. 4 is a sectional view of the liquid discharge head 31 that serves as a recording head of the image forming apparatus, parallel to the longer-side direction of a liquid chamber, according to the present embodiment.

Figure 5:
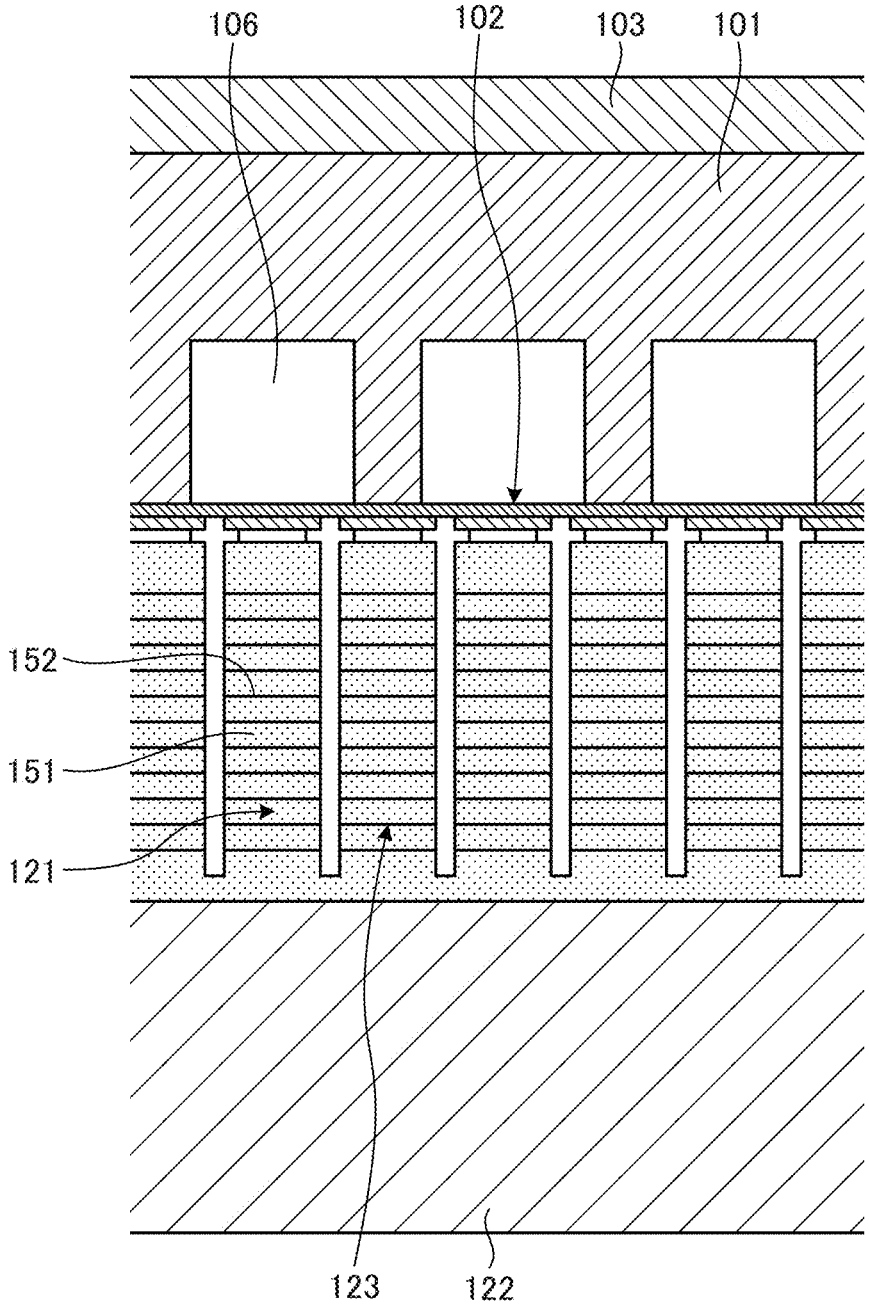
FIG. 5 is a sectional view of a liquid discharge head of an image forming apparatus, parallel to the shorter-side direction of a liquid chamber, according to an embodiment of the present disclosure.

FIG. 5 is a sectional view of the liquid discharge head 31 of the image forming apparatus, parallel to the shorter-side direction of a liquid chamber, according to the present embodiment.

In the liquid discharge head 31, a channel substrate 101, a vibration plate 102, and a nozzle plate 103 are bonded and stacked, so as to form, for example, a nozzle communication channel 105 and a liquid chamber 106 which serves as a duct through which a nozzle 104 communicates to discharge ink droplets, an ink supply port 109 that communicates with a common chamber 108 used to supply the liquid chamber 106 with ink.

The channel substrate 101 is formed by etching, for example, a steel special use stainless (SUS) substrate or a single-crystal silicon substrate. The vibration plate 102 is formed by, for example, nickel electroforming bonded to the bottom side of the channel substrate 101. The nozzle plate 103 is bonded to the top surface of the channel substrate 101.

Moreover, as an actuator element that serves as a pressure generator used to deform the vibration plate 102 to pressurize the ink in the liquid chamber 106, two rows of multi-layered piezoelectric elements 121 and a base substrate 122 that bonds and fixes the piezoelectric elements 121 are provided. A support portion 123 is provided for the two rows of the piezoelectric elements 121. The support portion 123 is formed at the same time as the piezoelectric elements 121 by dividing a component of the piezoelectric element. However, no driving voltage is applied to the support portion 123, and thus the support portion 123 is simply a columnar object.

Moreover, a flexible printed circuit (FPC) cable 126 that is connected to a driver integrated circuit (IC) is coupled to the piezoelectric elements 121. Further, a peripheral portion of the vibration plate 102 is bonded to the frame member 130.

A penetrating portion 131 and an ink feed hole 132 are formed through the frame member 130. The penetrating portion 131 accommodates an actuator unit composed of, for example, the piezoelectric elements 121 and the base substrate 122. The common chamber 108 and a concave portion that turns to become the common chamber 108 are supplied with ink externally through the ink feed hole 132. The frame member 130 is formed by injection molding using polyphenylene sulfite or thermosetting resin such as epoxide-based resin.

In the present embodiment, for example, the channel substrate 101 is formed by anisotropic etching in which a single-crystal silicon substrate having a crystal face orientation [110] is etched with an alkaline etching solution such as potassium hydroxide solution (KOH). Alternatively, the channel substrate 101 may be formed by etching a steel special use stainless (SUS) substrate. As a result, the nozzle communication channel 105, a concave portion that turns to become the liquid chamber 106, or a through-hole are formed.

The vibration plate 102 is made of a metal plate of nickel, and is formed by, for example, electroforming. However, no limitation is indicated thereby, and the vibration plate 102 may be formed using, for example, a metal plate, a combination of metal and resin plate. The piezoelectric elements 121 and the support portion 123 are bonded to the vibration plate 102 using an adhesive, and the frame member 130 is further bonded to the vibration plate 102 using an adhesive.

The nozzle plate 103 forms a nozzle 104 having a diameter of 10 to 30 μm corresponding to each liquid chamber 106, and is bonded to the channel substrate 101 with an adhesive. The nozzle plate 103 is formed by forming a water-repellent layer on the outermost surface of a nozzle forming member made of a metal member, having a prescribed layer therebetween. The surface of the nozzle plate 103 serve as face 31*a* the nozzle plate.

The piezoelectric elements 121 is a multi-layered piezoelectric element in which a piezoelectric material 151 and an internal electrode 152 are alternately stacked on top of each other. An individual electrode 153 and a common electrode 154 are connected to each internal electrode 152 pulled out to alternately different end faces of the piezoelectric elements 121.

In the present embodiment, the ink that is kept inside the liquid chamber 106 is pressurized using the shift in d33 direction as the piezoelectric direction of the piezoelectric elements 121. However, no limitation is indicated thereby, and the ink that is kept inside the liquid chamber 106 may be pressurized using the shift in d31 direction as the piezoelectric direction of the piezoelectric elements 121. Alternatively, one row of piezoelectric element 121 may be arranged on one base substrate 122.

In the liquid discharge head according to the present embodiment as described above, for example, as the voltage applied to the piezoelectric elements 121 is lowered from the reference potential, the piezoelectric elements 121 contracts, the vibration plate 102 descends, and the volume of the liquid chamber 106 expands. As a result, ink flows into the liquid chamber 106.

Then, the voltage applied to the piezoelectric elements 121 is increased to extend the piezoelectric elements 121 in the stacking direction, and the vibration plate 102 is deformed toward the nozzle 104 to reduce the size or volume of the liquid chamber 106. As a result, the recording liquid in the liquid chamber 106 is pressurized, and a drops of the recording liquid are discharged from the nozzle 104.

As the voltage applied to the piezoelectric elements 121 is returned to a reference potential, the vibration plate 102 is restored to the initial position, and the liquid chamber 106 expands. As a result, negative pressure is generated. Accordingly, the liquid chamber 106 is filled with the recording liquid from the common chamber 108. Accordingly, the vibration of the meniscus face of the nozzle 104 is attenuated and stabilized. Then, the operation shifts to the next droplet discharge operation.

The method of driving the head is not limited to the above-described example of the pull-and-push driving, and for example, the pull-and-push driving can also be performed depending on how the driving waveform is applied.

Figure 6:
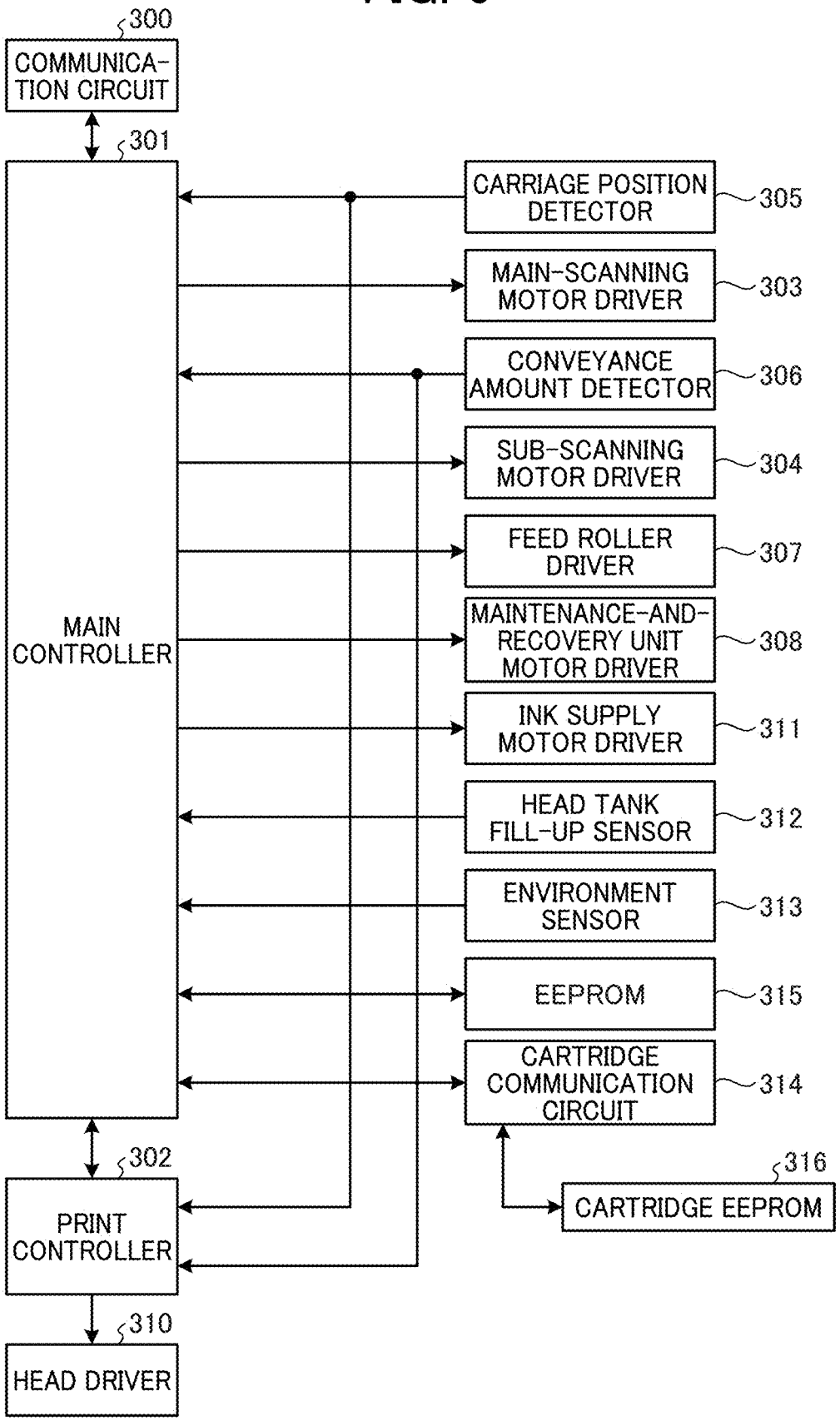
FIG. 6 is a schematic block diagram illustrating a controller of an image forming apparatus according to an embodiment of the present disclosure.

FIG. 6 is a schematic diagram illustrating the controllers of an image forming apparatus, according to the present embodiment.

The controller according to the present embodiment includes a main controller 301 and a print controller 302. The main controller 301 is constituted by a microcomputer serving also as a unit for controlling the entire image forming apparatus and performing control related to the dummy discharge operation according to the present invention. The print controller 302 is configured by a microcomputer or microprocessor that manages the printing operation. The print controller 302 corresponds to the discharge controller.

The main controller 301 performs control as follows to form an image on the sheet of paper 42 based on the print data input from the communication circuit 300. For example, the main-scanning motor 24 is controlled through the main-scanning motor driver 303, and the sub-scanning motor 58 is controlled through the sub-scanning motor driver 304. Moreover, print data may be sent to the print controller 302 in the above control performed by the main controller 301.

Moreover, the main controller 301 receives a detection signal from a carriage position detector 305 that detects the position of the carriage 23. The main controller 301 controls the moving position and the moving speed of the carriage 23 based on the received detection signal.

For example, the carriage position detector 305 causes a photodetector provided for the carriage 23 to read and count the number of slits of an encoder sheet arranged in the scanning direction of the carriage 23, to detect the position of the carriage 23.

The main-scanning motor driver 303 rotationally drives the main-scanning motor 24 in accordance with the amount of movement of the carriage 23, which is input from the main controller 301, to move the carriage 23 to a prescribed position at a prescribed speed.

The main controller 301 receives a detection signal from a carriage position detector 306 that detects the amount of movement of the conveyance belt 51. The main controller 301 controls the moving amount and the moving speed of the conveyance belt 51 based on the detection signal.

For example, the carriage position detector 306 causes a photodetector to read and count the number of slits of a rotary encoder sheet attached to the rotation axis of the conveyance roller 52, to detect the amount of conveyance.

The sub-scanning motor driver 304 drives the sub-scanning motor 58 to rotate according to the amount of conveyance input from the main controller 301, and drives the conveyance roller 52 to rotate to move the conveyance belt 51 to a prescribed position at a prescribed speed.

The main controller 301 according to the present embodiment provides the feed roller driver 307 with a feed roller drive command to rotate the feed roller 43 one time. The main controller 301 according to the present embodiment causes the maintenance-and-recovery unit motor driver 308 to rotate the motor 221 of the maintenance-and-recovery unit 81. As a result, as described above, the caps 82*a*, 82*b*, 82*c*, and 82*d* are moved up and down, and the wiper blade 83 is moved up and down. Moreover, for example, the suction pump is driven.

The main controller 301 according to the present embodiment controls the operation of the ink supply motor that drives the pump of the supply unit through an ink supply motor driver 311. According to such a configuration, ink is supplied from the ink cartridges 10*k*, 10*c*, 10*m*, and 10*y* inserted into the cartridge case 4 to the head tank 32. At that time, the main controller 301 detects that the head tank 32 is filled up. The supplying and filling operation is controlled based on a detection signal sent from a head tank fill-up sensor 312.

The main controller 301 according to the present embodiment causes a cartridge communication circuit 314 to obtain the data stored in a cartridge electrically erasable and programmable read only memory (EEPROM) 316 provided for each one of the ink cartridges 10*k*, 10*c*, 10*m*, and 10*y* accommodated in the cartridge case 4. Then, for example, the main controller 301 performs a required process and caused the EEPROM 315 to store the obtained data.

Further, a detection signal from an environment sensor 313 that detects an environmental temperature and an environmental humidity is input to the main controller 301.

The print controller 302 generates data used to drive the pressure generator that causes the recording heads 31*k*, 31*c*, 31*m*, and 31*y* to discharge ink droplets based on a signal sent from the main controller 301 and the carriage position and the amount of conveyance sent from, for example, the carriage position detector 305 and the carriage position detector 306. The print controller 302 transfers the generated data to the head driver 310 as serial data, and outputs, for example, a transfer clock, a latch signal, a mask signal as a drop control signal, which are used to transfer the data or determine the transfer, to the head driver 310.

Moreover, the print controller 302 includes a digital-to-analog (D/A) converter that performs digital-to-analog (D/A) conversion on the pattern data of the driving signals stored in a read only memory (ROM), a drive waveform generation unit, and a selector that selects a drive waveform to be given to a head driver. The drive waveform generation unit includes, for example, a voltage amplifier and a current amplifier. The print controller 302 generates a drive waveform including a plurality of driving signal groups each including one driving pulse or a plurality of driving pulses, which are driving signals, and outputs the drive waveform to the head driver 310.

The head driver 310 is a driver that supplies each one of the recording heads 31*k*, 31*c*, 31*m*, and 31*y* with a driving signal. More specifically, the head driver 310 drives the recording heads 31*k*, 31*c*, 31*m*, and 31*y* by selectively applying a driving signal to the driving elements of the recording heads 31*k*, 31*c*, 31*m*, and 31*y* based on prescribed image data.

The prescribed image data is, for example, image data corresponding to a single line of the recording heads 31*k*, 31*c*, 31*m*, and 31*y* that are serially input. The driving signal makes up a drive waveform given from the print controller 302. The driving element is, for example, a piezoelectric element as described above that is provided for each one of the recording heads 31*k*, 31*c*, 31*m*, and 31*y* to generate energy to discharge ink droplets.

In so doing, the driving pulse is selected from the driving signal groups that make up the drive waveform. As a result, ink droplets having different sizes can be discharged to print dots with different sizes separately.

Figure 7:
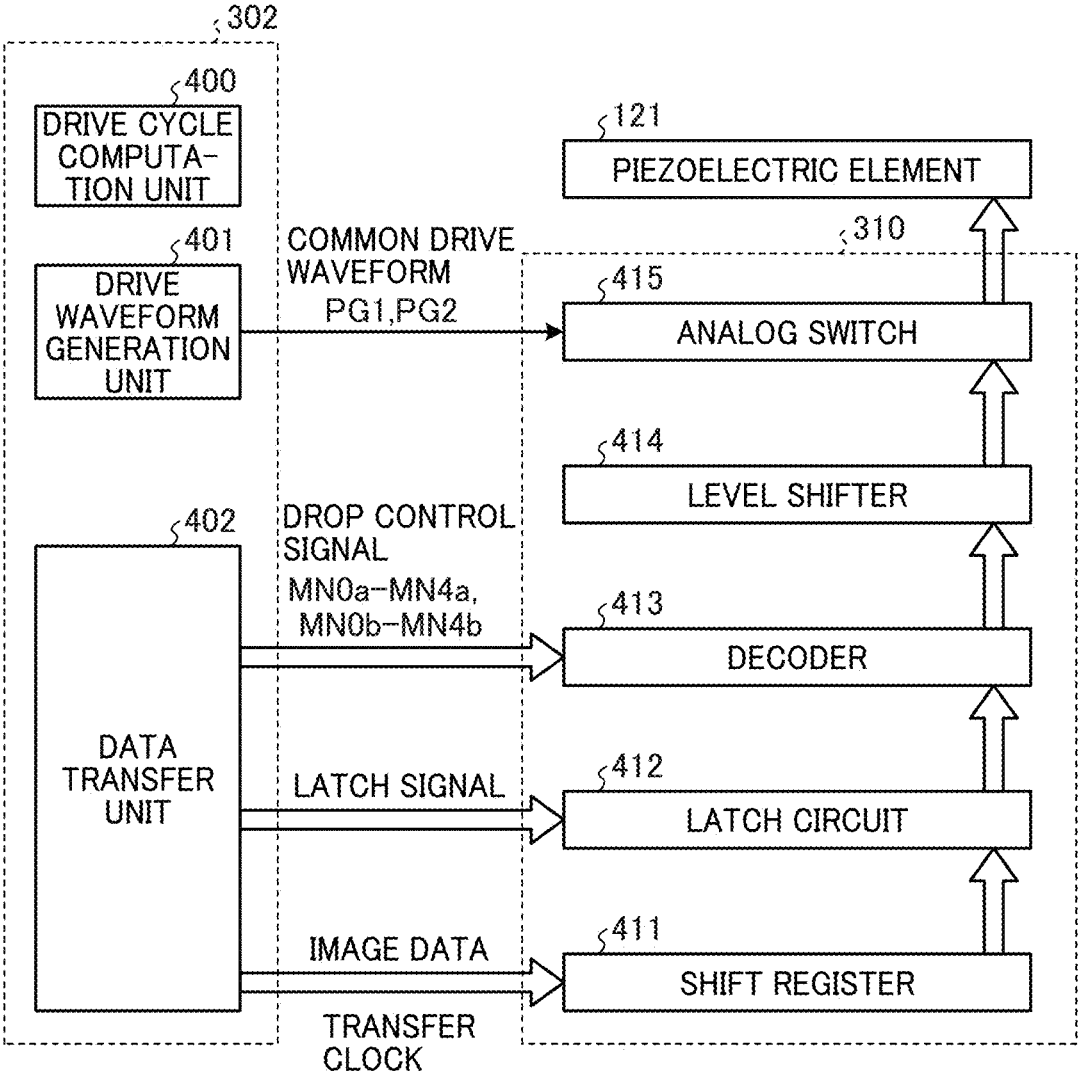
FIG. 7 is a block diagram illustrating a head driver and a print controller included in a controller, according to an embodiment of the present disclosure.

FIG. 7 is a diagram illustrating the print controller 302 and the head driver 310, according to the present embodiment.

The print controller 302 according to the present embodiment includes a drive cycle computation unit 400, a drive waveform generation unit 401, and a data transfer unit 402. The drive cycle computation unit 400 calculates a drive cycle. The drive waveform generation unit 401 generates and outputs a drive waveform, i.e., a common drive waveform. The data transfer unit 402 outputs 2-bit image data, i.e., gradation signals 0 and 1, corresponding to a print image, a clock signal, a latch signal, and drop control signals MN0 to MN3.

The drive cycle computation unit 400 computes the driving cycle based on the reading time interval of the slit of the encoder sheet by the carriage position detector 305, i.e., the amount of relative movement of the sheet. Then, the drive cycle computation unit 400 outputs the drive cycle obtained by the above calculation to the drive waveform generation unit 401, and causes the data transfer unit 402 to output various types of signals such as latch signals in the drive cycle obtained by the above calculation. How the drive cycle is calculated will be described later in detail.

The drive waveform generation unit 401 generates a drive waveform including two or more driving signals in one drive cycle. More specifically, as will be described later in detail with reference to FIG. 8A, the drive waveform generation unit 401 generates and outputs a drive waveform continuously including a first driving signal group PG1 including one or more driving signals and a second driving signal group PG2 including one or more driving signals in one drive cycle. In the present embodiment, an example in which the number of driving signal groups is two is described. However, no limitation is indicated thereby, and a configuration in which three or more driving signal groups are generated and output may be employed.

The data transfer unit 402 continuously outputs the drop control signals MN0 to MN3 for selecting the driving signal from the first driving signal group PG1 and the second driving signal group PG2 within one drive cycle, in view of the outputs from the first driving signal group PG1 and the second driving signal group PG2.

The drop control signals MN0 to MN3 are 2-bit signals used to instruct an analog switch 415, which is a switching unit of the head driver 310, to open and close. The drop control signals MN0 to MN3 make a state transition to the L level with a waveform to be selected in accordance with the cycle of the first driving signal group PG1 and the second driving signal group PG2, and make a state transition to the H level when no waveform is selected.

The head driver 310 according to the present embodiment includes a shift register 411, a latch circuit 412, a decoder 413, a level shifter 414, and an analog switch 415.

The shift register 411 receives from the data transfer unit 402 a shift clock as a transfer clock and gradation data (2 bits/CH) as serial image data. The latch circuit 412 latches each register value of the shift register 411 by a latch signal. The decoder 413 decodes the gray-scale data and the first and second drop control signals MN0*a* to MN3*a* and MN0*b* to MN3*b*, and outputs the result of decoding.

The level shifter 414 converts the logic-level voltage signal of the decoder 413 into a level at which the analog switch 415 can operate. The analog switch 415 is turned on and off by the output of the decoder 413 supplied through the level shifter 414. The analog switch 415 is coupled to one of the individual electrodes 153, which is the electrode selected by one of the multiple piezoelectric elements 121, and receives a common drive waveform from the drive waveform generation unit 401.

The analog switch 415 is turned on according to the serially transferred image data and the result of decoding of the drop control signals MN0 to MN3 by the decoder 413. As a result, required driving signals constituting the first driving signal group PG1 and the second driving signal group PG2 included in the common drive waveform are selected pass through, and are applied to the piezoelectric elements 121.

Figure 8A:
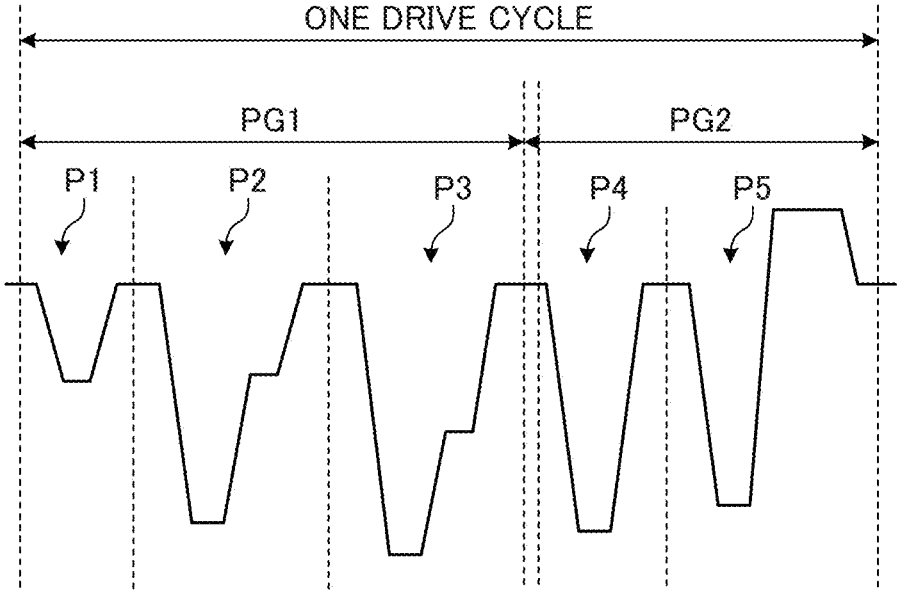
FIG. 8A and FIG. 8B are schematic diagrams each illustrating a drive waveform and a drop control signal used to select a driving signal that are generated and output by a drive waveform generation unit included in a print controller, according to an embodiment of the present disclosure.
Figure 8B:
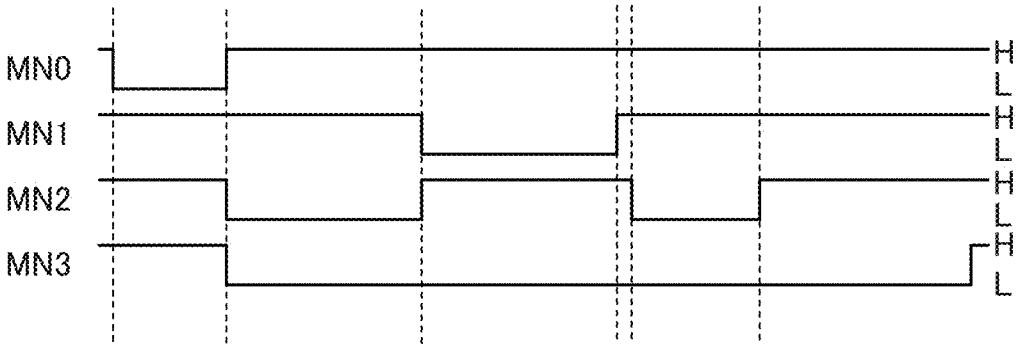

FIG. 8A and FIG. 8B are schematic diagrams each illustrating a drive waveform and a drop control signal used to select a driving signal that are generated and output by the drive waveform generation unit included in the print controller 302, according to the present embodiment.

Figures 9, 10:
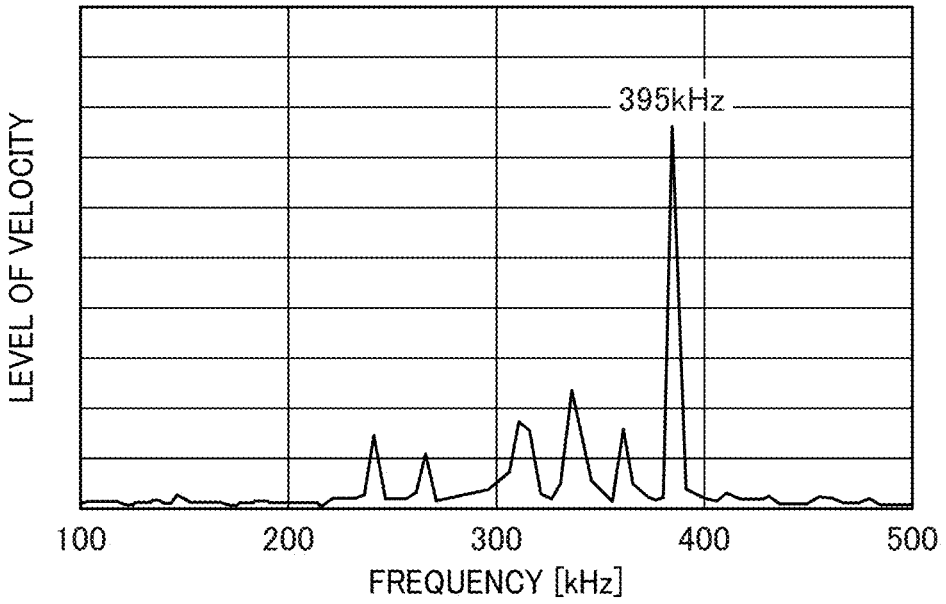
FIG. 9 is a schematic diagram illustrating the amount of drop to be discharged indicated by a drop control signal, according to an embodiment of the present disclosure.
FIG. 10 is a schematic diagram illustrating the frequency characteristics of the structural vibration of a recording head, according to an embodiment of the present disclosure.

FIG. 9 is a schematic diagram illustrating the amount of drop to be discharged indicated by a drop control signal, according to the present embodiment.

By way of example, the drive waveform output from the drive waveform generation unit 401 and the drop control signal output from the data transfer unit 402 are described below with reference to FIG. 8A, FIG. 8B, and FIG. 9. As illustrated in FIG. 8A, the first driving signal group PG1 output from the drive waveform generation unit 401 includes a non-discharge driving pulse P1 and discharge driving pulses P2 and P3.

The non-discharge driving pulse P1 consists of a waveform element falling from the reference potential, a waveform element held at the potential of falling edge, and a waveform element continuously rising to the post-hold reference potential. Each of the discharge driving pulse P2 and the discharge driving pulse P3 consists of a waveform element falling from the reference potential, a waveform element held at the potential of falling edge, and a waveform element gradually rising to the post-hold reference potential.

The non-discharge driving pulse indicates a driving pulse that drives the piezoelectric elements 121 but only gives vibration to the meniscus and does not discharge any ink droplet from the nozzle. The discharge driving pulse indicates a driving pulse used to drive the piezoelectric elements 121 to discharge an ink droplet from the nozzle.

The second driving signal group PG2, which is generated and output continuous to the first driving signal group PG1, consists of a discharge driving pulse P4 and a discharge driving pulse P5. The discharge driving pulse P4 consists of a waveform element falling from the reference potential, a waveform element held at the potential of falling edge, and a waveform element continuously rising to the post-hold reference potential.

The discharge driving pulse P5 consists of a waveform element falling from the reference potential, a waveform element held at the potential after the falling edge, a waveform element continuously rising to a potential higher than the post-hold reference potential, a waveform element held at the potential after the rising edge, and a waveform element falling to the post-hold reference potential.

In the present embodiment, the waveform element in which the potential V of the driving pulse falls from the reference potential Ve is a pull-in waveform element in which the piezoelectric elements 121 contracts and the volume of the pressurized liquid chamber 106 expands. Moreover, the waveform element that rises from the state after the fall is a pressurizing waveform element in which the piezoelectric elements 121 expands and the volume of the pressurizing liquid chamber 106 contracts.

In regard to the above drive waveform, as illustrated in FIG. 8B, the data transfer unit 402 sequentially outputs drop control signals MN0 to MN3 used to select the driving pulses P1 to P3 that together configure of the first driving signal group PG 1 and the driving pulses P4 and P5 that together configure the second drive waveform group PG2.

In the drop control signals MN0 to MN3, as illustrated in FIG. 9, when the drop control signal MN0 is given, only the driving pulse P1 is selected and given to the head. As a result, the driving is to be performed with non-discharge, and the amount of drop to be discharged is 0 pl.

In a similar manner to the above, when the drop control signal MN1 is given, only the driving pulse P3 is selected and given to the head. As a result, the amount of drop to be discharged is 3 pl. When the drop control signal MN2 is given, the driving pulses P2 and P4 are selected and given to the head, and the amount of drop to be discharged is 9 pl. Further, when the drop control signal MN3 is given, the driving pulses P2 to P5 are selected and given to the head, and the amount of drop to be discharged is 18 pl.

In other words, as the driving pulses P1 to P5 that form the drive waveform with four kinds of 2-bit drop control signals MN0 to MN3 are selected, four sizes of drops including non-discharge of 0 pl, a small drop of 3 pl, a medium drop of 9 p], and a large drop of 18 pl can be obtained. In other words, according to the present embodiment, droplets with different sizes can be discharged with a simple configuration.

FIG. 10 is a schematic diagram illustrating the frequency characteristics of the structural vibration of the recording head, according to the present embodiment.

In FIG. 10, the vertical axis indicates the velocity when the amount of deformation of the head nozzle surface during driving of one pressure chamber by sinusoidal wave input is measured by a laser Doppler meter, and the horizontal axis indicates the frequency of driving. The numerical value on the vertical axis corresponds to the amount of deformation of the head, and a larger numerical value indicates a larger amount of deformation of the head.

As is apparent from FIG. 10, with the recording head according to the present embodiment, a large resonance can be observed when the frequency is at 395 kilohertz (kHz). Although other resonances are observed, the peaks of those resonances are not as high as that of 395 kHz. Accordingly, 395 kHz may be considered to be a representative frequency in the present embodiment. If the peak value (resonance frequency) of the frequency of the resonance spectrum or the divisor of the resonance frequency coincides with or is close to the drive frequency (inverse number of the drive cycle) of the inkjet head, structural resonance of the recording head is excited and discharge stability is adversely affected. In other words, ink is abnormally discharged. As a result, the ink ejection accuracy deteriorates.

In order to handle such a situation, in the present embodiment, the drive cycle computation unit 400 adjusts the drive cycle to a value selected from a range different from a range including the resonance frequency or a frequency of a divisor of the resonance frequency. Accordingly, the precision of ink discharge can be prevented from deteriorating.

A method of calculating a drive cycle using the drive cycle computation unit 400 will be described below. As described above, the drive cycle computation unit 400 computes the driving cycle based on the reading time interval of the slit of the encoder sheet by the carriage position detector 305, which is the amount of relative movement of the sheet. Then, for example, the drive cycle computation unit 400 causes the data transfer unit 402 to output a latch signal to the head driver 310 in accordance with the calculated drive cycle.

In so doing, the reading time interval of the slit of the encoder sheet may be used as the drive cycle, or a value calculated by computation using the reading time interval of the slit of the encoder sheet may be used as the drive cycle. For example, when the reading time interval is set to a pitch of 150 dots per inch (dpi) and the discharge interval of the ink droplets is set to 300 dpi, the drive cycle computation unit 400 can set a cycle obtained by multiplying the reading time interval by ½ as the drive cycle. Moreover, in order to remove noise in the drive cycle, the drive cycle computation unit 400 can take a moving average for a plurality of consecutive drive cycles. The drive cycle that is computed by the processing up to this point is referred to as a before-adjustment drive cycle. The before-adjustment drive cycle corresponds to the first drive cycle.

Moreover, the drive cycle computation unit 400 adjusts the before-adjustment drive cycle to a value within another cycle range different from the cycle range in which abnormal discharge occurs due to resonance. The cycle range in which abnormal discharge occurs is a cycle range including the resonance frequency or a frequency of a submultiple of the resonance frequency, and corresponds to the first cycle range. The other cycle range that is different from the cycle range in which abnormal discharge occurs corresponds to the second cycle range. The drive cycle after adjustment corresponds to the second drive cycle. Note that the drive cycle after adjustment may be referred to as an after-adjustment drive cycle in the following description.

In order to prevent the landing position of the ink from being significantly displaced from the target position due to the adjustment of the drive cycle, the drive cycle computation unit 400 determines the value of the after-adjustment drive cycle from within the second cycle range such that the accumulated value of the prescribed number of consecutive after-adjustment drive cycles is approximately equal to the accumulated value of the prescribed number of before-adjustment drive cycles corresponding to the prescribed number of consecutive after-adjustment drive cycles. More specifically, the drive cycle computation unit 400 determines the value of the after-adjustment drive cycle from within the second cycle range so that the difference between the accumulated value of the prescribed number of consecutive after-adjustment drive cycles and the accumulated value of the prescribed number of consecutive before-adjustment drive cycles corresponding to the prescribed number of consecutive after-adjustment drive cycles does not exceed a permissible value.

More specifically, the drive cycle computation unit 400 computes a new after-adjustment drive cycle Tafter_cur so as to satisfy the following first condition and second condition.

First Condition $$(\text{Tafter_}cur > A\text{max}) \text{ or } (A\text{min} > \text{Tafter_}cur)$$

Second Condition $$|\text{SUM (Tafter)} - \text{SUM (Tbefore)}| < Z$$

In the above condition, Amax denotes an upper limit of the cycle range in which abnormal ejection occurs, and Amin denotes a lower limit of the cycle range in which abnormal ejection occurs. SUM (Tbefore) denotes the accumulated value of the latest n consecutive before-adjustment drive cycles Tbefore including the before-adjustment drive cycle Tbefore_cur that is the source of the new after-adjustment drive cycle Tafter_cur, and SUM denotes an operator that indicates accumulation. SUM (Tafter) denotes an accumulated value of the latest n consecutive after-adjustment drive cycles Tafter including the new after-adjustment drive cycle Tafter_cur. N denotes an example of a prescribed number of times, and is a natural number of two or more. Z denotes an example of a permissible value, and is any positive real number.

Some of or all of the inequality signs included in the first condition and the second condition may be an inequality sign with an equal sign.

The drive cycle computation unit 400 performs adjustment to obtain a before-adjustment drive cycle Tbefore every time the before-adjustment drive cycle Tbefore passes one or more times. In the following description, it is assumed that the drive cycle computation unit 400 performs adjustment to obtain a before-adjustment drive cycle Tbefore every time the before-adjustment drive cycle Tbefore passes one time.

Figure 11:
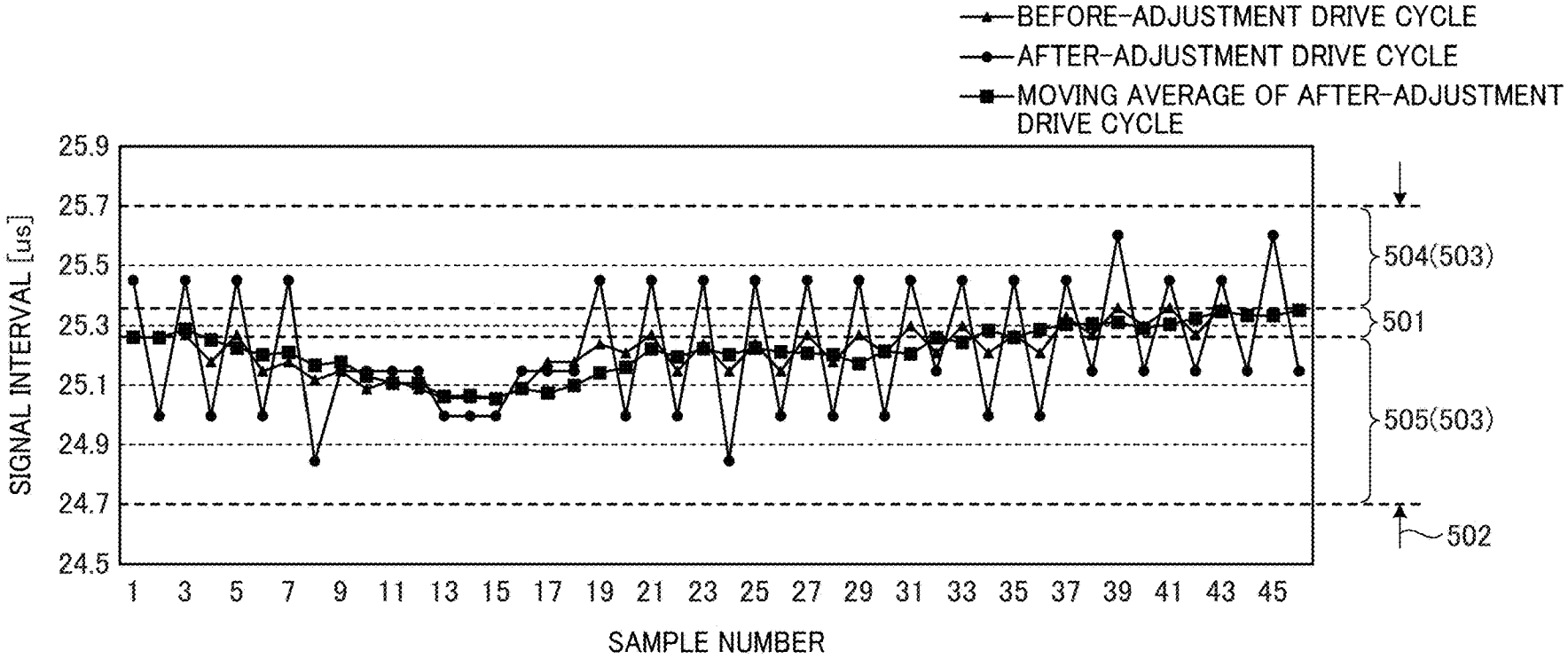
FIG. 11 is a graph illustrating the progression of drive cycles computed by a drive cycle computation unit, according to an embodiment of the present disclosure.

FIG. 11 is a graph illustrating the progression of drive cycles computed by the drive cycle computation unit 400, according to the present embodiment.

In the present embodiment, the resonance frequencies of the head are around 395 kHz. In such cases, in order to avoid resonance of the structure of the head, it is desired that a drive cycle of a multiple of a period of 2.53 microseconds (p) be avoided. Accordingly, in the drive cycle computation unit 400, the cycle range 501 having a prescribed width including 2.53 μs is set as the first cycle range in which the discharge abnormality occurs due to resonance.

Further, the drive cycle can be set within the cycle range 502 if the discharge abnormality is not taken into consideration. Accordingly, the cycle range 503 from which the cycle range 501 in the cycle range 502 is excluded is adopted as the second cycle range. The second cycle range is a cycle range in which a discharge abnormality due to resonance is does not occur.

The cycle range 502 includes the cycle range 501. Accordingly, the cycle range 503 is divided into a cycle range 504 that contacts the upper limit of the cycle range 501 and a cycle range 505 that contacts the lower limit of the cycle range 501. The cycle range 504 corresponds to the third cycle range. The cycle range 505 corresponds to the fourth cycle range.

The triangular dots represent the progression of the before-adjustment drive cycle. The circular dots represent the progression of the after-adjustment drive cycle. Although the before-adjustment drive cycle is partially included in the cycle range 501 where the discharge may be performed abnormally, it is interpreted from the graph that the after-adjustment drive cycle is set so as to avoid the cycle range 501. In other words, if the after-adjustment drive cycle is used, the structural resonance of the recording head can be prevented, and thus the precision of the ink discharge can be prevented from deteriorating.

The square dots represents five-point moving averages of the after-adjustment drive cycle. It is interpreted from FIG. 11 that the five-point moving averages of the after-adjustment drive cycle approximately match the progression of the before-adjustment drive cycle. This is achieved because a sufficiently small value is set as the parameter Z used in the second condition.

The after-adjustment drive cycle is computed by adjusting the value of the before-adjustment drive cycle calculated so as to correspond to the amount of relative movement of the sheet of paper. Accordingly, when a value that deviates from the before-adjustment drive cycle is used as the after-adjustment drive cycle, the position at which ink is to be discharged is locally displaced from the target position. Moreover, the amount of displacement of each drive cycle is accumulated every time the drive cycle has passed. However, as the after-adjustment drive cycle is set so that the moving average of the after-adjustment drive cycle approximately matches the progression of the before-adjustment drive cycle, the amount of displacement of the position at which ink is to be discharged from the target position can be prevented from increasing due to accumulation.

Any real number may be set as the parameter Z. For example, the value obtained by dividing the distance determined according to the target resolution by the relative speed of the sheet of paper with respect to the carriage can be set as the parameter Z. As the parameter Z is determined in view of the target resolution, the influence of the displacement of the position at which ink is to be discharged from the target position on the image quality can be prevented.

In one example, the distance determined in view of the target resolution, which is as described above, may be considered to be half the distance of the intervals at which ink is to be discharged in view of the target resolution. Accordingly, the influence of the displacement of the position at which ink is to be discharged from the target position on the image quality can be reduced to a level such an influence cannot visually be recognized. The distance that determined based on the target resolution is not limited to the above value.

In the example illustrated in FIG. 11, the value of an after-adjustment drive cycle is alternately selected from the cycle range 504 and the cycle range 505, for each before-adjustment drive cycle. In other words, the value of the after-adjustment drive cycle is selected from one of the cycle range 504 and the cycle range 505, and then the value of the after-adjustment drive cycle is selected from the other of the cycle range 504 and the cycle range 505. The value of the after-adjustment drive cycle is not selected twice or more continuously from one of the cycle range 504 and the cycle range 505. As the value of the after-adjustment drive cycle is selected in such a manner as described above, the amount of displacement of the position at which ink is to be discharged from the target position can be reduced to a small amount compared with a case in which the selection source of the value of the after-adjustment drive cycle is switched between the cycle range 504 and the cycle range 505 every time two or more values of the after-adjustment drive cycle are selected.

The selection source of the value of the after-adjustment drive cycle may be switched between the cycle range 504 and the cycle range 505 every time two or more values of the after-adjustment drive cycle are selected.

n may be any natural number equal to or greater than 2. However, as n is smaller, the accumulated amount of displacement of the landing position of the ink from the target position can be reduced to a smaller amount. Accordingly, the influence on image quality can be reduced.

Figure 12:
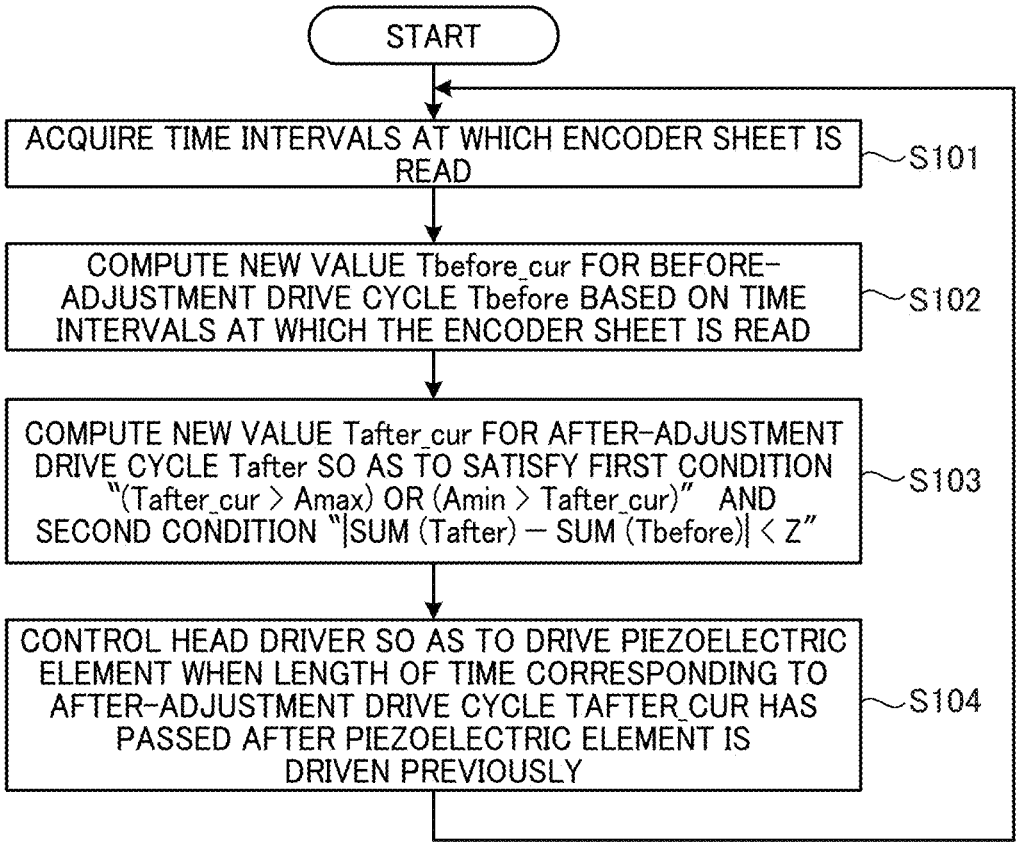
FIG. 12 is a flowchart of the operation of an image forming apparatus according to an embodiment of the present disclosure.

FIG. 12 is a flowchart of the operation of the image forming apparatus according to the present embodiment.

Firstly, in a step S101, the print controller 302 acquires time the intervals at which the encoder sheet is read from the carriage position detector 305. Then, in a step S102, the drive cycle computation unit 400 computes a new value Tbefore_cur for a before-adjustment drive cycle Tbefore based on the acquired time intervals at which the encoder sheet is read.

As described above, the drive cycle computation unit 400 may set the reading time interval of the encoder sheet to Tbefore_cur. Alternatively, the drive cycle computation unit 400 may perform prescribed processing such as division, multiplication, and moving averaging on the reading time interval of the encoder sheet, and may set a value obtained by the processing as Tbefore_cur.

Subsequently, in a step S103, the drive cycle computation unit 400 computes a new value Tafter_cur for an after-adjustment drive cycle Tafter so as to satisfy the above first condition and second condition.

Then, in a step S104, the print controller 302 controls the head driver 310 so as to drive the piezoelectric elements 121 when the length of time corresponding to the after-adjustment drive cycle Tafter_cur has passed after the piezoelectric elements 121 is driven previously.

Then, the control shifts to a step S101. The destination of the control after the S104 is not limited to the S101. After the step S104, the control may shift to the step S102 or S103. For example, when the reading time interval is set to a pitch of 150 dots per inch (dpi) and the discharge interval of the ink droplets is set to 300 dpi, a pair of the steps S103 and S104 may be repeated twice and then the control may shift to the S101.

In the embodiment as described above with reference to FIG. 12, the computation of the after-adjustment drive cycle is performed every time the value of the after-adjustment drive cycle is used one time. The computation of the after-adjustment drive cycle may be performed every time the value of the after-adjustment drive cycle is used two or more times. In other words, the computation of the after-adjustment drive cycle may be performed every time the after-adjustment drive cycles passes one or more times.

As described above, according to the present embodiment, the image forming apparatus that serves a liquid discharge apparatus includes the head driver 310 and the print controller 302 that serves as a discharge controller. The head driver 310 drives an actuator element such as the piezoelectric elements 121 that generate force to discharge an ink droplet from the head onto an object to be conveyed such as a sheet of paper that moves relative to the head. The print controller 302 computes a first drive cycle such as a before-adjustment drive cycle according to the amount of relative movement the object to be conveyed. Then, the print controller 302 adjusts the first drive cycle to a value within a second cycle range such as the cycle range 503 that is different from the first cycle range such as the cycle range 501 in which ink is abnormally discharged. As a result, a second drive cycle such as an after-adjustment drive cycle can be obtained. Then, the print controller 302 causes the head driver to drive the actuator elements in the second drive cycle. The print controller 302 executes processing for obtaining the second drive cycle every time the second drive cycles passes one or more times. Further, the print controller 302 adjusts the first drive cycle so that the difference between the accumulated value of the first drive cycle of a prescribed number of consecutive times such as n times and the accumulated value of the second drive cycle of a prescribed number of consecutive times such as n times does not exceed a permissible value such as Z.

Accordingly, the deterioration of the precision of discharging the ink droplet due to the resonance can be prevented.

More specifically, the print controller 302 adjusts the first drive cycle so as to satisfy the first condition and the second condition described above.

Accordingly, the landing position of the ink from can be prevented from being significantly displaced from the target position.

According to the present embodiment, a value obtained by dividing the distance determined according to the target resolution by the conveyance speed of the object to be conveyed can be set as a permissible value.

Accordingly, the influence of the displacement of the position at which ink is to be discharged from the target position on the image quality can be prevented.

According to the present embodiment, a value obtained by dividing a half value of the discharge position interval corresponding to the target resolution by the conveyance speed of the object to be conveyed can be set as a permissible value.

Accordingly, the influence of the displacement of the position at which ink is to be discharged from the target position on the image quality can be reduced to a level where such an influence cannot visually be recognized.

According to the present embodiment, a prescribed number of times is determined according to the target resolution.

Accordingly, the influence of the displacement of the position at which ink is to be discharged from the target position on the image quality can be reduced. According to the present embodiment, when the target resolution is "a" dpi, a value larger than the value obtained by the computation of 4×a/25.4 can be set as a prescribed number of times such as n times.

According to the present embodiment, the second cycle range includes a third cycle range such as the cycle range 504 that contacts the upper limit of the first cycle range and a fourth cycle range such as the cycle range 505 that contacts the lower limit of the first cycle range.

According to the present embodiment, the print controller 302 alternately adjusts the first drive cycle to the value within the third cycle range and the value within the fourth cycle range every time the after-adjustment drive cycle passes.

Accordingly, the amount of displacement of the position at which ink is to be discharged from the target position can be reduced compared with cases in which the first drive cycle is alternately adjusted to the value within the third cycle range and the value within the fourth cycle range every time the after-adjustment drive cycles passes two or more times.

According to the present embodiment, a method of discharging liquid includes a first step such as the steps S101 and S102 as illustrated in FIG. 12 of computing a first drive cycle according to the amount of relative movement of an object to be conveyed such as a sheet of paper moving relative to the head, a second step such as the repetition of the step S103 in FIG. 12 of adjusting the first drive cycle to a value within a second cycle range different from the first cycle range in which ink droplets are abnormally discharged from the head to obtain a second drive cycle that is the adjusted first drive cycle as in, for example, the step S103 in FIG. 12 every time the second drive cycles passes one or more times, and, and a third step such as the step S104 in FIG. 12 of driving an actuator element that generates force to discharge an ink droplet from the head onto an object to be conveyed in the second driving cycle.

Accordingly, the deterioration of the precision of discharging the ink droplet due to the resonance can be prevented.

According to the present embodiment, the second step corresponds to a step of adjusting the first drive cycle so that the difference between the accumulated value of the first drive cycle of a prescribed number of consecutive times such as n times and the accumulated value of the second drive cycle of a prescribed number of consecutive times such as n times does not exceed a permissible value such as Z.

Accordingly, the amount of displacement of the position at which ink is to be discharged from the target position can be prevented from increasing due to accumulation.

In the above embodiment of the present disclosure, the liquid discharge apparatus is applied to an image forming apparatus of serial type in which the carriage 23 provided with the recording head in the direction orthogonal to the conveyance direction of a sheet of paper moves. However, no limitation is indicated thereby, and the liquid discharge device according to the above embodiments of the present disclosure may be applied to any kind of image forming apparatus.

For example, the liquid discharge apparatus according to the above embodiments of the present disclosure can also be applied to an image forming apparatus of line type in which the recording head relatively moves in the direction same as the conveyance direction of a sheet of paper to form an image. In such cases, an encoder that is arranged to detect the conveyance speed of a sheet of paper is read by a photosensor. Then, the first drive cycle is computed based on the read time interval by the photosensor, and the second drive cycle is computed in the same procedure as described above.

Moreover, even in a case where the liquid discharge apparatus according to the above embodiments of the present disclosure is applied to one of the serial-type image forming apparatus and the line-type image forming apparatus, the method of detecting the amount of relative movement of an object to be conveyed is not limited to the method of reading an encoder by a photosensor. The liquid discharge apparatus according to the above embodiments of the present disclosure can acquire the amount of relative movement of an object to be conveyed adopting any sort of method.

Moreover, the liquid discharge apparatus according to the above embodiments of the present disclosure can be applied to an any apparatus or device that discharges droplets of liquid from a nozzle to an object to be conveyed that moves relative to the nozzle.

Note that the liquid discharge device and the liquid discharging liquid according to the above embodiments of the present disclosure are preferred example embodiments of the present disclosure, and various applications and modifications may be made without departing from the scope of the invention. Further, any of the above-described multiple processes of the liquid discharging method according to the above embodiments of the present disclosure can be implemented as a hardware device such as a special-purpose circuit or device, software such as a program, or as a combination of both hardware and software such as a processor executing a software program.

Any one of the above-described multiple processes of the liquid discharging method according to the above embodiments of the present disclosure may be embodied in the form of a computer program stored in any kind of storage medium provided for a dedicated hardware. A sequence of operation is stored in such a storage medium, and is executed as instructed. Examples of such a storage medium include, but are not limited to, for example, a flexible disk, a hard disk, an optical disc, a magneto-optical disc, a magnetic tape, a nonvolatile memory card, and read-only-memory (ROM). Alternatively, any one of the above-described multiple processes of the liquid discharging method according to the above embodiments of the present disclosure may be implemented by one or more programmed general-purpose microprocessors capable of performing various kinds of operations or processes.

The program that includes a sequence of operation for the above-described multiple processes of the liquid discharging method according to the above embodiments of the present disclosure is a file in an installable or executable file format, and may be stored in a computer-readable recording medium such as a compact disk read-only memory (CD-ROM), a flexible disk (FD), a compact disk recordable (CD-R), and a digital versatile disk (DVD).

Moreover, the program that includes a sequence of operation for the above-described multiple processes of the liquid discharging method according to the above embodiments of the present disclosure may be stored in a computer connected to a network such as the Internet, and may be downloaded through the network. Further, a program that includes a sequence of operation for the above-described multiple processes of a liquid discharging method according to the above embodiments of the present disclosure may be distributed or downloaded through the network such as the Internet.

Note that numerous additional modifications and variations are possible in light of the above teachings. It is therefore to be understood that within the scope of the appended claims, the disclosure of the present disclosure may be practiced otherwise than as specifically described herein. For example, elements and/or features of different illustrative embodiments may be combined with each other and/or substituted for each other within the scope of this disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge device comprising:

a head driver configured to drive an actuator element to generate force to discharge an ink droplet from a head onto an object to be conveyed, the object to be conveyed moving relative to the head; and a discharge controller configured to compute a first drive cycle based on an amount of relative movement of the object to be conveyed, adjust the first drive cycle to a value within a second cycle range different from a first cycle range in which the ink droplet is abnormally discharged, cause the head driver to drive the actuator element in a second drive cycle obtained as a result of adjustment performed on the first drive cycle, perform adjustment on the first drive cycle every time the second drive cycle passes one or more times, and adjust the first drive cycle such that a difference between an accumulated value of the first drive cycle of a prescribed number of consecutive times and an accumulated value of the second drive cycle of the prescribed number of consecutive times does not exceed a permissible value.

2. The liquid discharge device according to claim 1, wherein the discharge controller is configured to adjust the first drive cycle to satisfy (Tafter_cur>Amax) or (Amin>Tafter_cur) and

|SUM (Tafter)−SUM (Tbefore)|<Z where

Amax denotes an upper limit of the first cycle range,

Amin denotes a lower limit of the first cycle range, n denotes a natural number of two or more, and indicates the prescribed number of consecutive times, SUM (Tbefore) denotes the accumulated value of the first drive cycle of the prescribed number of consecutive times, SUM (Tafter) denotes the accumulated value of the second drive cycle of the prescribed number of consecutive times, and Z denotes a positive real number, and indicates the permissible value.

3. The liquid discharge device according to claim 1, wherein the permissible value is obtained by dividing a distance determined according to a target resolution by a conveyance speed of the object to be conveyed.

4. The liquid discharge device according to claim 3, wherein the distance is a half distance of intervals at which ink is discharged in view of the target resolution.

5. The liquid discharge device according to claim 1, wherein the second cycle range includes a third cycle range contacting an upper limit of the first cycle range and a fourth cycle range contacting a lower limit of the first cycle range.

6. The liquid discharge device according to claim 5, wherein the discharge controller is configured to alternately adjust the first drive cycle to a value within the third cycle range and a value within the fourth cycle range every time the second drive cycle passes.

7. A method of discharging liquid, the method comprising:

computing a first drive cycle according to an amount of relative movement of an object to be conveyed moving relative to a head;

adjusting the first drive cycle to a value within a second cycle range different from a first cycle range in which an ink droplet is abnormally discharged from the head;

obtaining a second drive cycle as a result of adjustment performed on the first drive cycle, every time the second drive cycle passes one or more times;

adjusting the first drive cycle such that a difference between an accumulated value of the first drive cycle of a prescribed number of consecutive times and an accumulated value of the second drive cycle of a prescribed number of consecutive times does not exceed a permissible value; and driving an actuator element that generates force to discharge an ink droplet from the head onto the object to be conveyed in the second driving cycle.

* * * * *